US011380250B1

(12) United States Patent
Tseng et al.

(10) Patent No.: US 11,380,250 B1
(45) Date of Patent: Jul. 5, 2022

(54) DISPLAY APPARATUS HAVING A SELF-LUMINOUS PIXEL MODULE AND A FIRST NON-SELF-LUMINOUS PIXEL MODULE DRIVEN BY A PULSE WIDTH MODULATION DRIVING CIRCUIT

(71) Applicant: Shih-Hsien Tseng, Hsinchu (TW)

(72) Inventors: Shih-Hsien Tseng, Hsinchu (TW); Chih-Wen Lu, Hsinchu (TW)

(73) Assignee: Shih-Hsien Tseng, Hsinchu (TW)

( * ) Notice: Subject to any disclaimer, the term of this patent is extended or adjusted under 35 U.S.C. 154(b) by 0 days.

(21) Appl. No.: 17/243,540

(22) Filed: Apr. 28, 2021

(51) Int. Cl.
*G09G 3/32* (2016.01)
*G09G 3/34* (2006.01)

(52) U.S. Cl.
CPC ..... *G09G 3/32* (2013.01); *G09G 3/344* (2013.01); *G09G 3/3426* (2013.01); *G09G 2320/064* (2013.01)

(58) Field of Classification Search
None
See application file for complete search history.

(56) References Cited

U.S. PATENT DOCUMENTS

| | | | | |
|---|---|---|---|---|
| 7,061,460 | B2 | 6/2006 | Shimizu | |
| 10,566,315 | B2 | 2/2020 | Tseng | |
| 2008/0074060 | A1 | 3/2008 | Ye | |
| 2009/0135317 | A1 | 5/2009 | Lynam | |
| 2012/0086684 | A1* | 4/2012 | Ichioka | G09G 3/3406 345/207 |
| 2016/0204169 | A1* | 7/2016 | Oh | H01L 27/326 257/40 |
| 2017/0309215 | A1* | 10/2017 | Perdices-Gonzalez | G09G 3/2003 |
| 2019/0371218 | A1* | 12/2019 | Kagawa | G03B 21/005 |
| 2020/0126961 | A1 | 4/2020 | Tseng | |

FOREIGN PATENT DOCUMENTS

| | | | |
|---|---|---|---|
| CN | 202813107 | U | 3/2013 |
| CN | 103187020 | A | 7/2013 |

(Continued)

OTHER PUBLICATIONS

Sharp Corporation ,"Sharp Develops Free-Form Display, Enables Vastly Greater Design Freedom for Displays", https://global.sharp/corporate/news/140618.html ,Jun. 18, 2014.

(Continued)

*Primary Examiner* — Matthew Yeung
(74) *Attorney, Agent, or Firm* — Winston Hsu

(57) ABSTRACT

A display apparatus has a self-luminous pixel module, a first non-self-luminous pixel module, and a pulse width modulation (PWM) driving circuit. The self-luminous pixel module has a plurality of self-luminous pixels. The first non-self-luminous pixel module is disposed on the self-luminous pixel module and has a plurality of first non-self-luminous pixels. The self-luminous pixel module of the display apparatus is used as a backlight for the non-self-luminous pixel module. The PWM driving circuit provides first PWM signals to the self-luminous pixel module to control values of brightness of the self-luminous pixels and provides second PWM signals to the first non-self-luminous pixel module to control values of transmittance of the first non-self-luminous pixels.

18 Claims, 15 Drawing Sheets

(56) References Cited

FOREIGN PATENT DOCUMENTS

| | | | |
|---|---|---|---|
| CN | 110873982 | A | 3/2020 |
| CN | 111710306 | A | 9/2020 |

OTHER PUBLICATIONS

Merck ,"Merck Announces Partnerships to Ad-vance Materials for Flexible, Foldable and Rollable OLED Displays", https://www.merckgroup.com/en/news/liviflex-01-12-2020.html ,Dec. 1, 2020.
Lindquist,"Pulse-width modulation drive technique for high-resolution liquid-crystal gratings," Optics Letters, vol. 20, No. 5, pp. 510-512, Mar. 1, 1995.
"International Search Report" dated Mar. 1, 2022 for International application No. PCT/CN2021/137654, International filing date:Dec. 14, 2021.

* cited by examiner

DISPLAY APPARATUS HAVING A SELF-LUMINOUS PIXEL MODULE AND A FIRST NON-SELF-LUMINOUS PIXEL MODULE DRIVEN BY A PULSE WIDTH MODULATION DRIVING CIRCUIT

BACKGROUND OF THE INVENTION

1. Field of the Invention

The present invention relates to a display apparatus, and more specifically, the present invention relates to a display apparatus having a self-luminous pixel module and a first non-self-luminous pixel module driven by a pulse width modulation (PWM) driving circuit.

2. Description of the Prior Art

With the advancement of technology, users are getting more picky about visual displays and desire display devices with a high compactness, excellent display quality, large-sized panel, high color saturation, low cost and low power consumption.

Existing display devices may be categorized into self-luminous and non-self-luminous ones. Liquid crystal display (LCD) devices are one of the primary non-self-luminous flat panel display devices, wherein the amount of light passing through a liquid crystal medium is modulated by controlling the voltage of upper and lower electrodes of the liquid crystal medium. The effect of color display is achieved with further employment of a color filter layer, a polarizer and some optical films.

Self-luminous flat panel display devices may be categorized into field emissive display, plasma display, electroluminescent display, photoluminescent material, organic light-emitting diode display and so on. In an organic light-emitting diode display (OLED), light-emitting polymers are deposited between an upper electrode layer and a lower electrode layer. With further employment of a conductive layer of electrons and holes, light is generated by means of an external electric field which moves the carriers and causes the electrons and holes to re-combine. In comparison, an organic light-emitting diode display device is characterized by its wide viewing angle, fast responding speed, thin panel and flexibility; further, it requires neither backlight nor color filter and may be made large-sized.

SUMMARY OF THE INVENTION

An embodiment of the present invention provides a display apparatus. The display apparatus comprises a self-luminous pixel module, a first non-self-luminous pixel module, and a pulse width modulation (PWM) driving circuit. The self-luminous pixel module comprises a plurality of self-luminous pixels. The first non-self-luminous pixel module is disposed on the self-luminous pixel module and comprises a plurality of first non-self-luminous pixels. The pulse width modulation (PWM) driving circuit is configured to provide first PWM signals to the self-luminous pixel module to control values of brightness of the self-luminous pixels and provide second PWM signals to the first non-self-luminous pixel module to control values of transmittance of the first non-self-luminous pixels.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
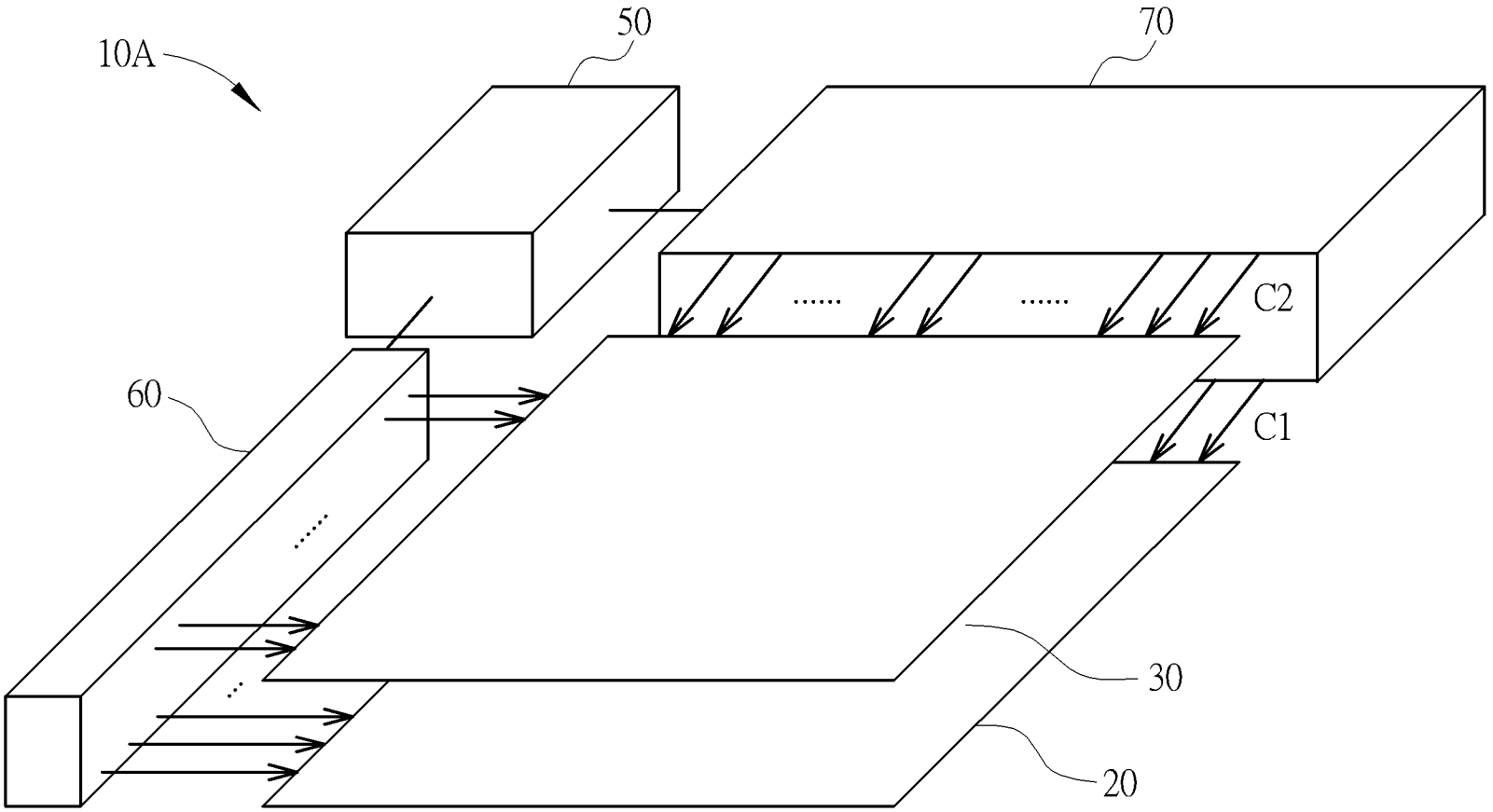
FIG. 1 shows a structure of a display apparatus according to an embodiment of the present invention.

The implementation method of the present invention will be further illustrated by way of the following description of a plurality of embodiments. But it should be noted that the embodiments described below are illustrative and exemplary only rather than limiting the application of the present invention to the described environment, application, structure, procedure or steps. Elements that are not directly related to the present invention are ignored from the drawings. The scale relations among elements in the drawings are for illustration rather than limiting of the actual scales of the present invention. Unless noted otherwise, identical (or similar) reference symbols correspond to identical (or similar) elements.

The display apparatus of the present invention may be a free-form display apparatus, which provides customized shapes and novel design features, and its surfaces could be bent, folded, stretched or rolled up. This revolutionary advancement opens up a new world for designers of automotive vehicles, wearable devices, and other types of products.

The display apparatus of the present invention may be a freeform display with a multi-layer display structure. A self-luminous pixel module of the display apparatus may serve as a backlight for a plurality of non-self-luminous pixel modules of the display apparatus (only shown one or two non-self-luminous pixel modules). The self-luminous pixel module also offers local dimming to enhance the color contrast ratio. Active-matrix and/or Passive-matrix organic light-emitting diodes (OLED) are good candidates for the components of the self-luminous pixel module, also active-matrix and/or passive-matrix liquid crystal display (LCD) panels are good candidates for the components of the non-self-luminous pixel module of the freeform display. Furthermore, the self-luminous pixel module may comprise at least one member selected from a group consisting of an electroluminescent material, a photoluminescent material, a cathodoluminescent material, a field emissive luminescent material, a phosphorescent material, a fluorescent material, a vacuum fluorescent material, and a light-emitting diode material. Moreover, the non-self-luminous pixel module may comprise at least one member selected from a group consisting of an electrophoretic material, an electric fluid material, a liquid crystal material, a micro electromechanical reflective material, an electrowetting material, an electric ink material, a magnetic fluid material, an electrochromic material, an electromorphous material, and a thermochromic material. Moreover, the self-luminous and/or non-self-luminous pixel modules further include a light absorbing material, a light reflecting material, a light deflecting material, a light diffusing material, a light-filtering material, an electric conductive material, an insulating material, and a photo reflective material for enhancing the performance of display pixel modules.

The luminous of the self-luminous pixel module may be controlled by pulse-width modulation (PWM) scheme, and the non-self-luminous pixel module may be driven using a voltage and/or current driven modes. The transmittance of an LCD module (e.g., an LCD panel) depends on the root mean square (RMS) value of an applied voltage across the LC module, regardless of the polarity of the voltage. Therefore, the gray level of a pixel of the LC module may be controlled by the voltage level applied across the LC module. Alternatively, the gray level may be controlled with PWM scheme.

In the present invention, the PWM scheme for the freeform display with a self-luminous pixel module and a plurality of non-self-luminous pixel modules (only shown one or two non-self-luminous pixel modules). The resolution of self-luminous pixel module may be equal, less or greater than the resolution of the non-self-luminous pixel modules, simplistically, to select the resolution of self-luminous pixel module less than the resolution of the non-self-luminous pixel modules illustrated. The gray level is controlled by adjusting the brightness of the self-luminous pixel module and the transmittance of the non-self-luminous pixel module (s) with PWM driving circuit schemes.

Figure 2:
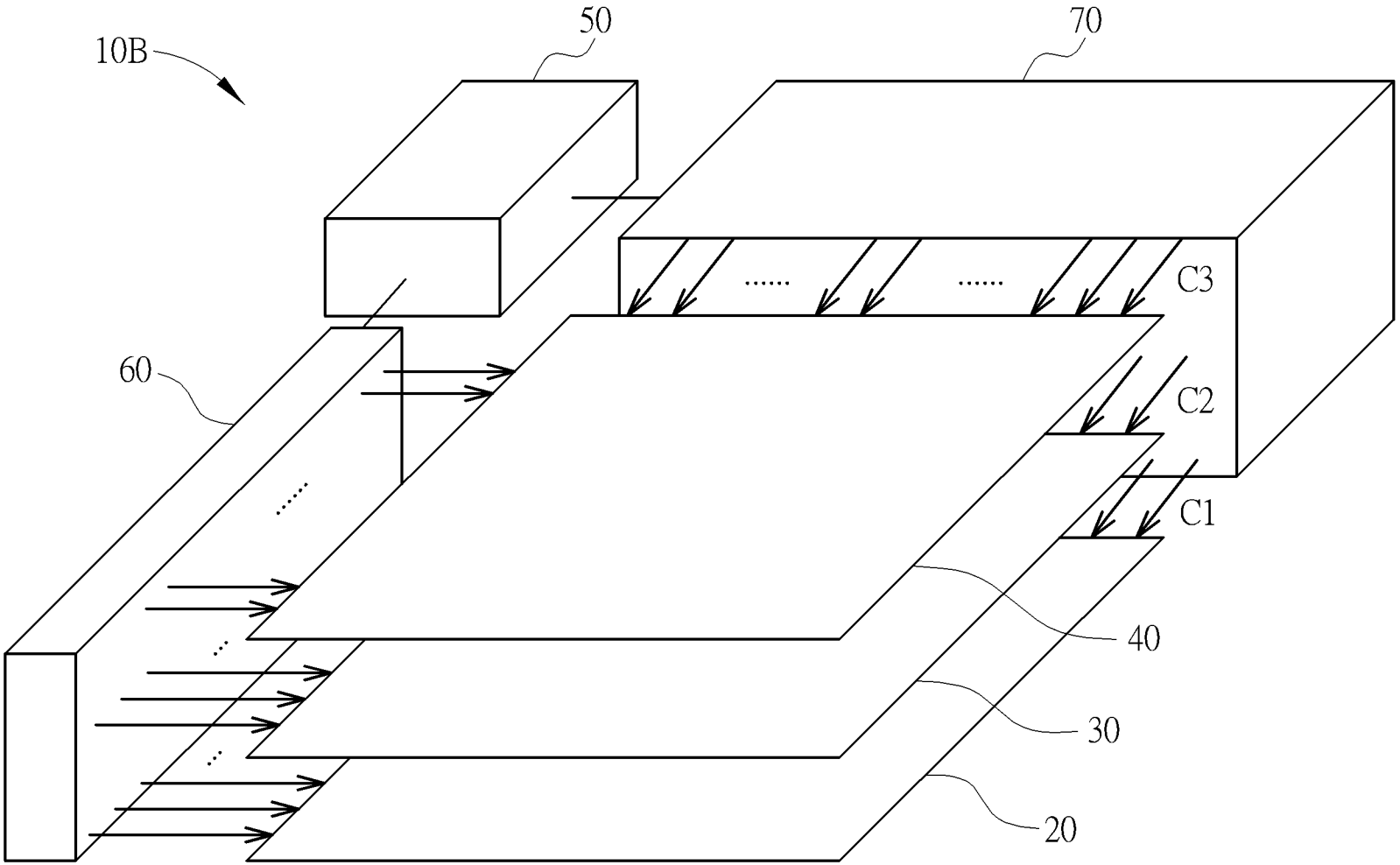
FIG. 2 shows a structure of another display apparatus according to another embodiment of the present invention.

FIG. 1 shows a structure of a display apparatus 10A according to an embodiment of the present invention, and FIG. 2 shows a structure of another display apparatus 10B according to another embodiment of the present invention. The display apparatus 10A has a two-layer display structure, and the display apparatus 10B has a three-layer display structure. In other words, each of the display apparatuses 10A and 10B is a multi-layer display, which combines a self-luminous pixel module 20 (e.g., an electroluminescent panel, OLED) and one or two non-self-luminous pixel modules 30 and 40 (e.g., liquid crystal panels, LCD). The self-luminous pixel module 20 is used as the backlight of the non-self-luminous pixel modules 30 and 40, and provides local dimming to achieve a wider color gamut and a higher contrast ratio of the display apparatuses 10A and 10B. The gray level of each pixel of the display apparatuses 10A may be adjusted by controlling the brightness of the self-luminous pixel module 20 and by controlling the transmittance of the non-self-luminous pixel module 30. An extra non-self-luminous pixel module 40 may be included to form the three-layer display 10B as shown in FIG. 2 to achieve a much wider color gamut and a much higher contrast ratio. The display apparatus 10A further comprises a timing controller (Tcon) 50, a scan driver 60, and a pulse width modulation (PWM) driving circuit 70. The PWM driving circuit 70 is used as a column driver. The timing controller 50 controls the scan driver 60 to scan the self-luminous pixel module 20 and the non-self-luminous pixel module 30, and sends the image data to the PWM driving circuit 70.

Figure 3:
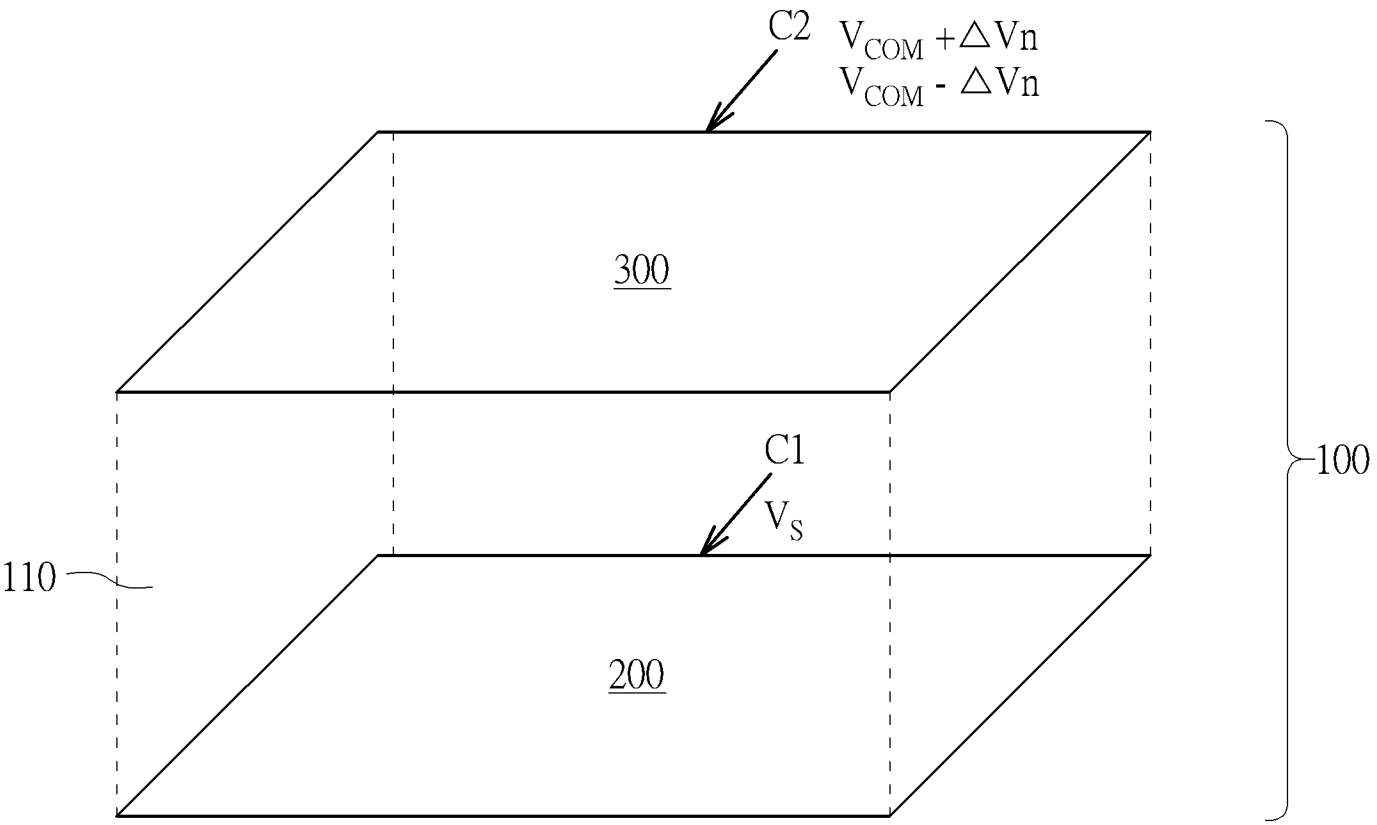
FIG. 3 shows a pixel group of the display apparatus in FIG.

FIG. 3 shows a pixel group 100 of the display apparatus 10A in FIG. 1. The display apparatus 10A comprises a plurality of the pixel groups 100, and each pixel group 100 comprises a self-luminous pixel 200 and a non-self-luminous pixel 300. In other words, the self-luminous pixel module 20 comprises a plurality of self-luminous pixels 200 and a plurality of non-self-luminous pixels 300, and the self-luminous pixels 200 and the non-self-luminous pixels 300 form the plurality of the pixel groups 100 of the display apparatus 10A. In the embodiment, each pixel group 100 serves as a display pixel 110 of the display apparatus 10A.

In the embodiment, the PWM driving circuit 70 is a pulse width modulation (PWM) driving circuit to drive the self-luminous pixel module 20 and the non-self-luminous pixel module 30 to control the gray levels of the pixels of the display apparatus 10A according to the image data received from the timing controller 50. In detail, the PWM driving circuit 70 provides first PWM signals C1 to the self-luminous pixel module 20 to control brightness of self-luminous pixels 200 and provides second PWM signals C2 to the non-self-luminous pixel module 30 to control transmittance of the non-self-luminous pixels 300.

In the embodiment shown in FIG. 2, the scan driver 60 further scans the non-self-luminous pixel module 40, and the PWM driving circuit 70 further drives the non-self-luminous pixel module 40 to control the gray levels of the pixels of the display apparatus 10B according to the image data received from the timing controller 50. The PWM driving circuit 70 provides third PWM signals C3 to the non-self-luminous pixel module 40 to control transmittance of non-self-luminous pixels of the non-self-luminous pixel module 40.

Figure 4:
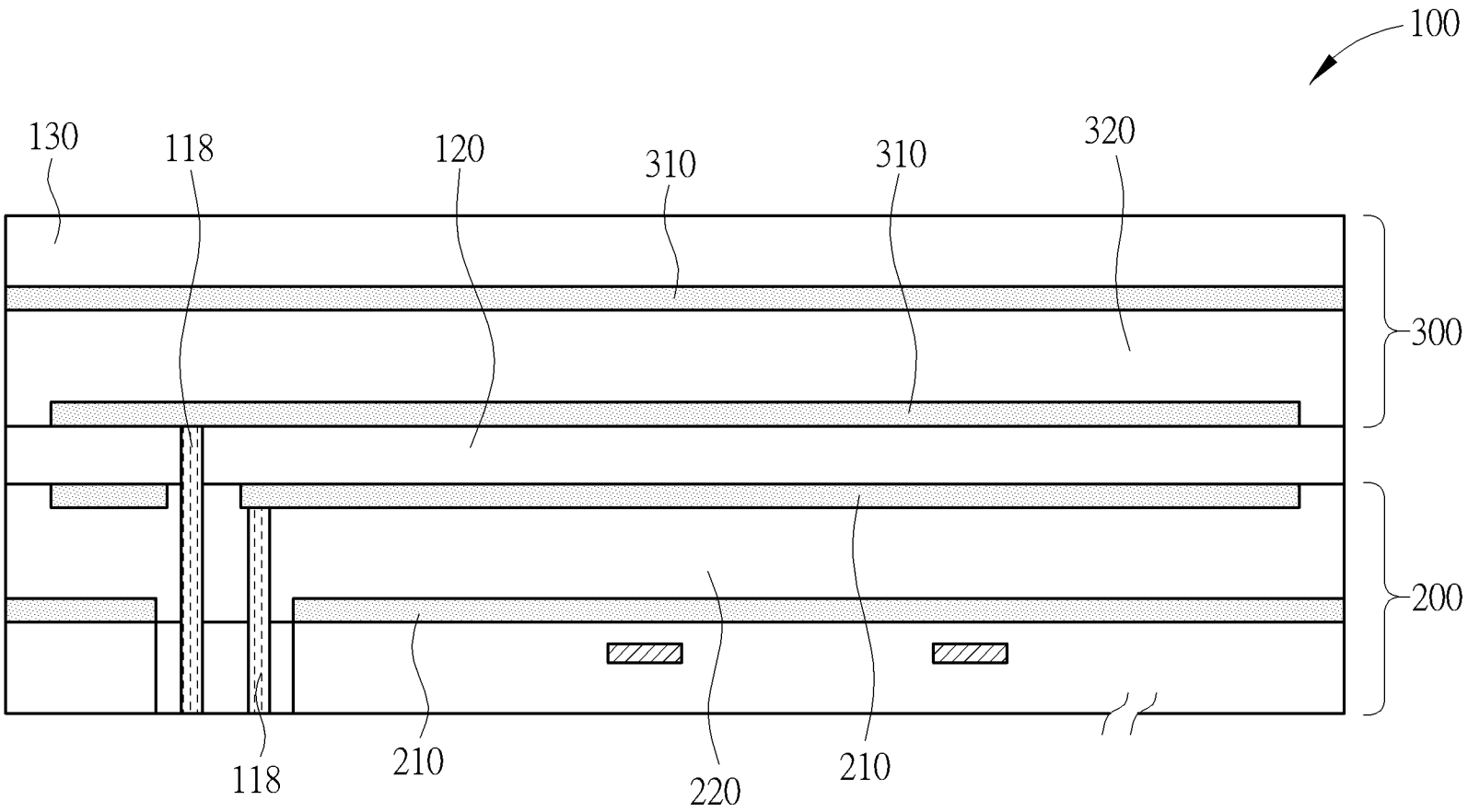
FIG. 4 is a cross-section view of the pixel group in FIG. 3.

FIG. 4 is a cross-section view of the pixel group 100 in FIG. 3. The self-luminous pixel 200 comprises two electrodes 210, and a self-luminous medium 220 is disposed between the two electrodes 210. The self-luminous medium 220 may comprise at least one member selected from a group consisting of an electroluminescent material, a photoluminescent material, a cathodoluminescent material, a field emissive luminescent material, a vacuum fluorescent material, and a light-emitting diode material. The non-self-luminous pixel 300 comprises two electrodes 310, and a non-self-luminous medium 320 (e.g., a liquid crystal (LC) layer) is disposed between the two electrodes 310. The non-self-luminous medium 320 may comprise at least one member selected from a group consisting of an electrophoretic material, an electric fluid material, a liquid crystal material, a micro electromechanical reflective material, an electrowetting material, an electric ink material, a magnetic fluid material, an electrochromic material, an electromorphous material, and a thermochromic material. Moreover, the non-self-luminous pixel module 30 may further comprise a first substrate 120 and/or a second substrate 130, one of the two electrodes 310 is disposed on the first substrate 120, and the other electrode 310 is disposed on the first and/or second substrate 130 (e.g., the electrodes 310 may be disposed on the same substrate if the non-self-luminous medium 320 is in-plane-switching (IPS) liquid crystal). The first substrate 120 and/or the second substrate 130 may comprise at least one member selected from a group consisting of a transparent material, an opaque material, a flexible material, a rigid material, a metallic material, a ceramic material, an insulating material, a metal compound material, a metal alloy material, an organic material, an inorganic material, a composite material, and a semiconductor material.

The PWM driving circuit 70 is electrically connected to the electrodes 210 of the self-luminous pixel module 20 and the electrodes 310 of the non-self-luminous pixel module 30 via conductors 118 to control the electrodes 210 and 310 in a synchronized and/or non-synchronized manner to allow the electrodes 210 to change the state of the self-luminous medium 220 and allow the electrodes 310 to change the state of the non-self-luminous medium 320.

The self-luminous pixel module 20 and/or the non-self-luminous pixel module 30 may further comprise at least one member selected from a group consisting of a light absorbing material, a light reflecting material, a light deflecting material, a light diffusing material, alight-filtering material, an electric conductive material, an insulating material, and a photo reflective material for enhancing the performance of display pixel modules.

The shape of the self-luminous pixel module 20 and/or the shape of the non-self-luminous pixel module 30 may be selected from a group consisting of a square shape, a rectangle shape, a fan shape, a triangle shape, a trapezoid shape, a circle shape, an oval shape, a diamond shape, an irregular polygon shape, a polygon shape, and an irregular shape.

Figure 5:
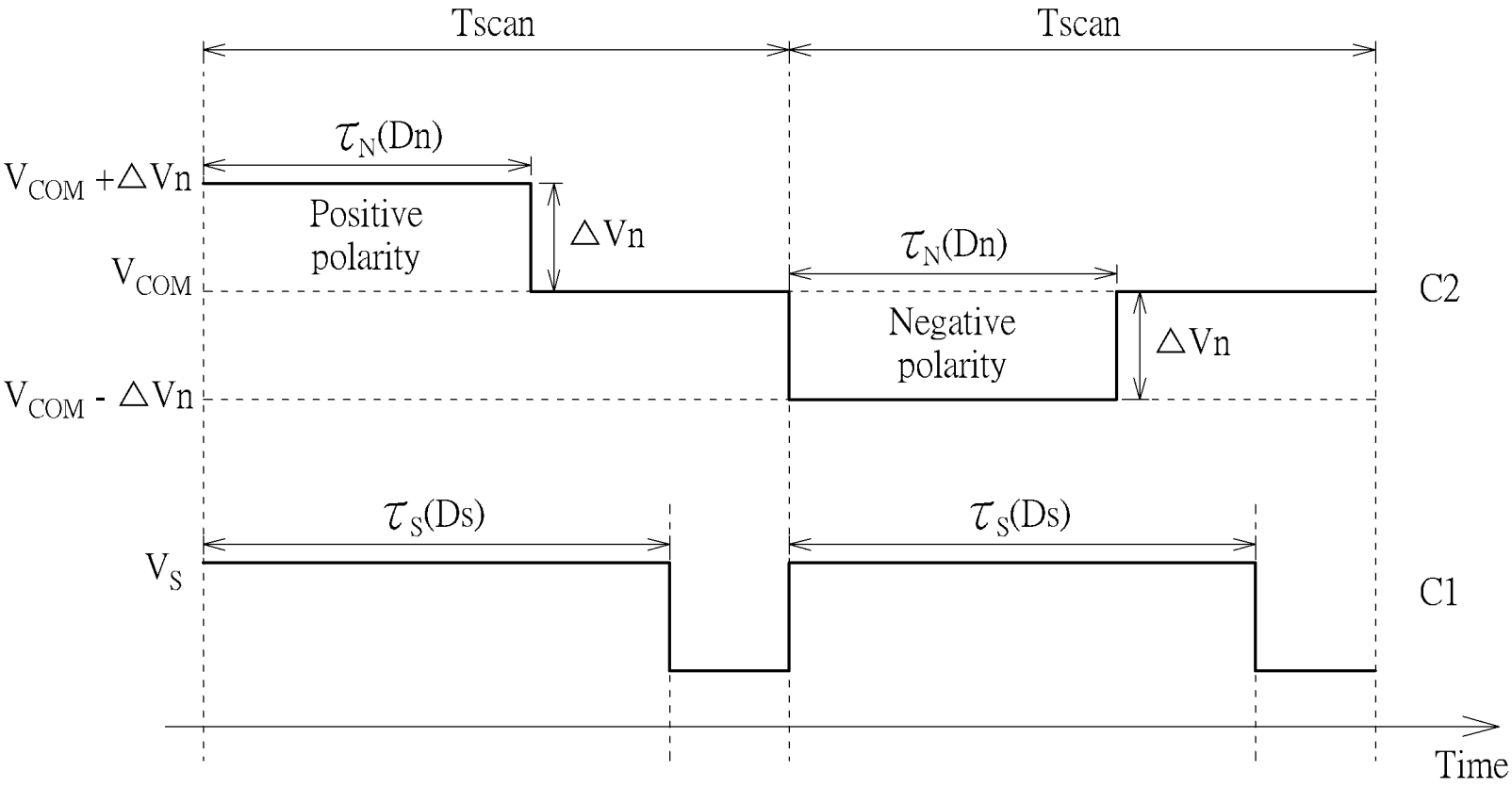
FIG. 5 is a timing diagram of the pixel group in FIG. 3.

FIG. 5 is a timing diagram of the pixel group 100 in FIG. 3. The driving voltage $V_S$ is the voltage applied to the self-luminous pixels 200 when the self-luminous pixel module 20 is turned on. The brightness of the whole display apparatus 10A can be adjusted by varying the driving voltage $V_S$. The driving voltage $V_S$ is one of the first PWM signals C1 provided by the PWM driving circuit 70. A common voltage $V_{COM}$ is applied to a common electrode of the non-self-luminous pixel module 30 (e.g., a liquid crystal panel). The PWM driving circuit 70 further applies the driving voltages ($V_{COM}$+ΔVn) and ($V_{COM}$−ΔVn) to the driving electrode of the non-self-luminous pixel 300 for positive polarity driving and negative polarity driving respectively. The driving voltages ($V_{COM}$+ΔVn) and ($V_{COM}$−ΔVn) are determined by one of the second PWM signal C2. The transmittance of the non-self-luminous pixel 300 depends on the root mean square (RMS) value of the applied voltages ($V_{COM}$+ΔVn) and ($V_{COM}$−ΔVn) regardless of the polarity of the voltage across the non-self-luminous medium 320 of the non-self-luminous pixel 300. For the PWM scheme, the periods of the voltage driving voltage ($V_{COM}$+ΔVn) and/or ($V_{COM}$−ΔVn) controls the transmittance of the non-self-luminous pixel 300. The transmittance of the non-self-luminous pixel 300 is $T_N$ when the voltage driving voltage is ($V_{COM}$+ΔVn) or ($V_{COM}$−ΔVn). Since the non-self-luminous medium 320 cannot completely block the light, the transmittance of the non-self-luminous pixel 300 is a non-zero value, $T_{COM}$, when a voltage difference between the two electrodes 310 of the non-self-luminous pixel 300 is zero. The gray level of the display pixel 110 can be changed by adjusting the brightness of the self-luminous pixel 200 and the transmittance of the non-self-luminous pixel 300. In the embodiment, the PWM driving circuit 70 provides the first PWM signal C1 (i.e, $V_S$) to the self-luminous pixel 200 to adjust the brightness of the self-luminous pixel 200 and provides the second PWM signal C2 (i.e., ($V_{COM}$+ΔVn) and ($V_{COM}$−ΔVn)) to the non-self-luminous pixel 300 to adjust the transmittance of the non-self-luminous pixel 300. The period $\tau_S$ is the period when the self-luminous pixel 200 is turned on by the driving voltage $V_S$. The period $\tau_N$ is the period when the driving voltage ($V_{COM}$+ΔVn) or ($V_{COM}$−ΔVn) is applied across the non-self-luminous medium 320 of the non-self-luminous pixel 300. The period $\tau_S$ is greater than the period $\tau_N$. The gray level $G_p$ of display pixel 110 could be expressed as:

$$G_p = B_S \frac{[\tau_N \cdot T_N + (\tau_S - \tau_N) \cdot T_{COM}]}{T_{scan}} \tag{1}$$

where $T_{scan}$ is the scan time while the scan driver 60 applies a scan voltage to the pixel group 100. $B_S$ is the brightness of the self-luminous pixel 200 when the voltage $V_S$ is applied to the self-luminous pixel 200. The ratio $D_S=(\tau_S/T_{scan})$ is the duty cycle when the voltage $V_S$ is applied to the self-luminous pixel 200, and the ratio $D_N=\tau_N/T_{scan})$ is the duty cycle when the voltage driving voltage ($V_{COM}$+ΔVn) or ($V_{COM}$−ΔVn) is applied across the non-self-luminous medium 320 of the non-self-luminous pixel 300. Therefore, the gray level $G_p$ of the pixel group 100 could be expressed as:

$$G_p=B_S[D_N \cdot T_N+(D_S-D_N) \cdot T_{COM}] \tag{2}$$

According to the equation (2), the gray level $G_p$ of the display pixel 110 can be controlled by adjusting the duty cycles $D_S$ and $D_N$. For given image data for the gray level $G_p$, the duty cycles $D_S$ and $D_N$ could be determined based on the equation (2).

Figure 6:
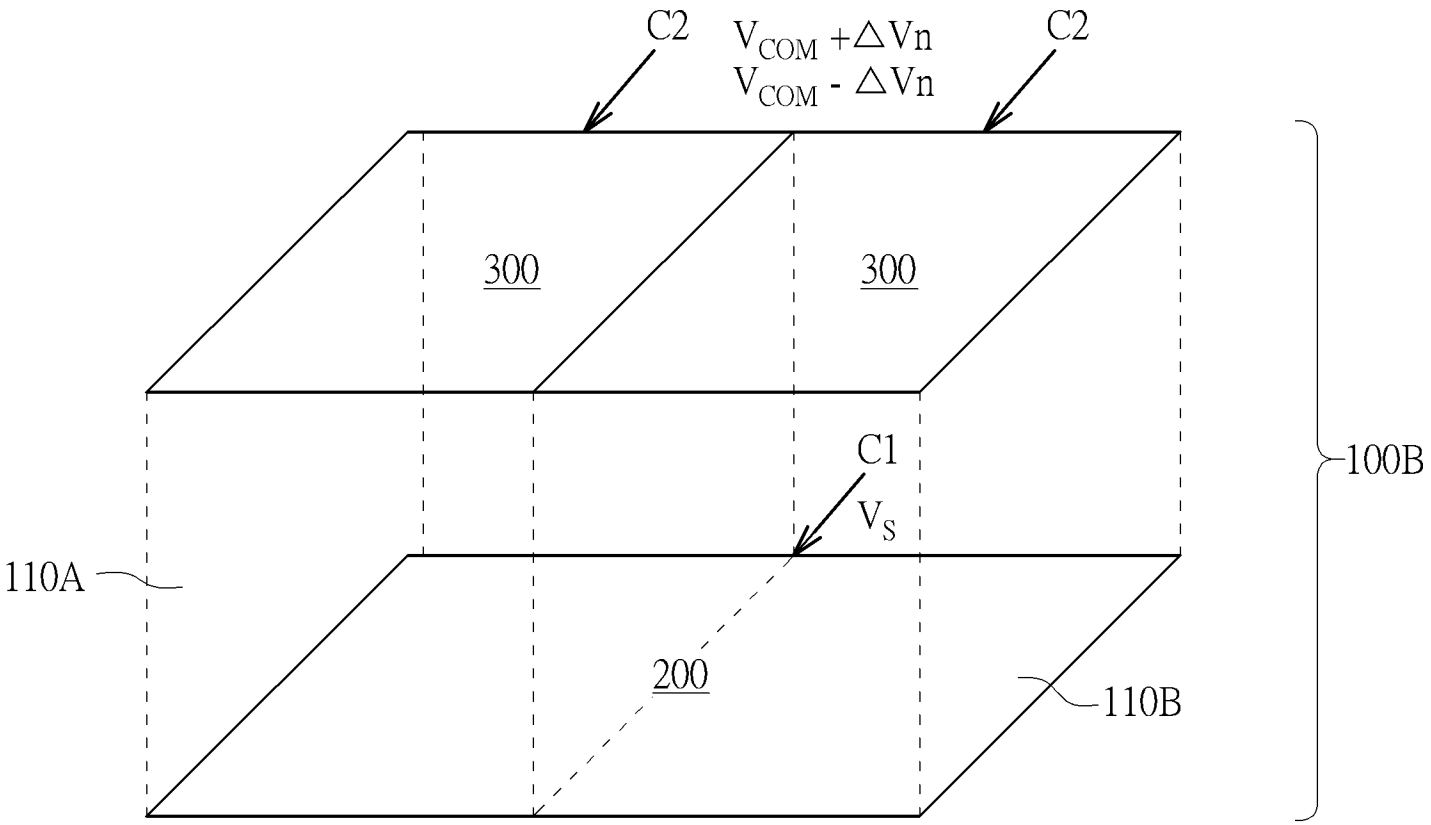
FIG. 6 shows another pixel group composed of a self-luminous pixel and two non-self-luminous pixels aligned vertically.
Figure 7:
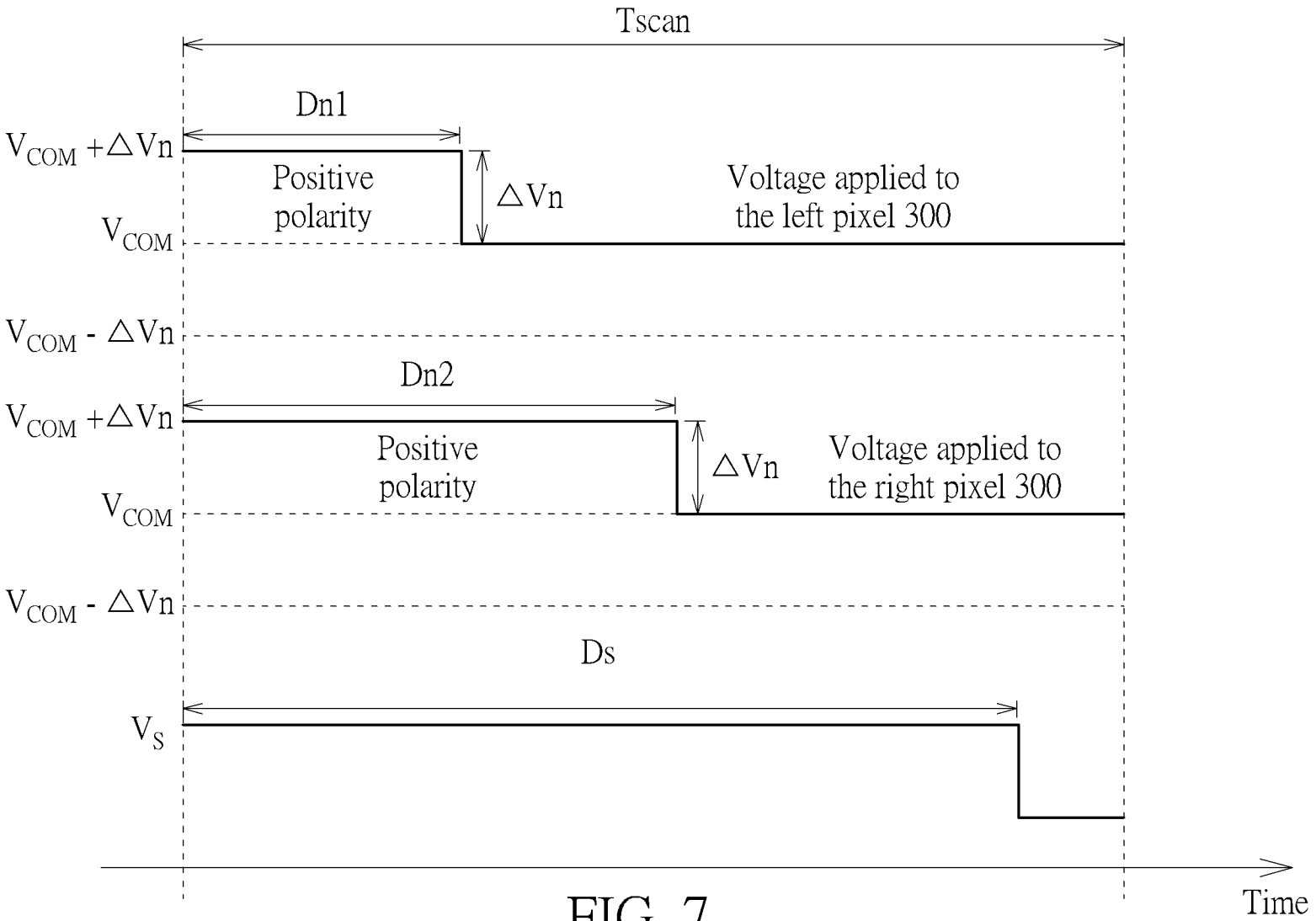
FIG. 7 shows the PWM driving timing of the pixel group in FIG. 6.

To reduce the cost of the self-luminous pixel module 20, each self-luminous pixel 200 may supply the backlight and offer local dimming to multi non-self-luminous pixels 300 of the non-self-luminous pixel module 30. FIG. 6 shows a pixel group 100B composed of a self-luminous pixel 200 and two non-self-luminous pixels 300 aligned vertically. The two non-self-luminous pixels 300 are placed in the same row and are driven by two second PWM signals C2 output from the PWM driving circuit 70. In the embodiment, each pixel group 100B serves as two display pixels 110A and 110B of the display apparatus 10A. FIG. 7 shows the PWM driving timing of the pixel group 100B. For simplicity, only positive polarity driving of the two non-self-luminous pixels 300 is illustrated in FIG. 7. $D_{N1}$ is the duty cycle when the voltage driving voltage ($V_{COM}$+ΔVn) or ($V_{COM}$−ΔVn) is applied across the left non-self-luminous pixel 300, and $D_{N2}$ is the duty cycle when the voltage driving voltage ($V_{COM}$+ΔVn) or ($V_{COM}$−ΔVn) is applied across the right non-self-luminous pixel 300. The gray level $G_{p1}$ of the display pixel 110A could be expressed as:

$$G_{p1}=B_S[D_{N1} \cdot T_N+(D_S-D_{N1}) \cdot T_{COM}] \tag{3}$$

The gray level $G_{p1}$ of the display pixel 110A could be controlled by adjusting the duty cycles $D_S$ and $D_{N1}$.

The gray level $G_{p2}$ of the display pixel 110B could be expressed as:

$$G_{p2}=B_S[(D_{N2} \cdot T_N+(D_S-D_{N2}) \cdot T_{COM}] \tag{4}$$

$B_S$ is brightness of the self-luminous pixel 200 when the voltage Vs is applied to the self-luminous pixel 200, $D_1$ is the duty cycle of the voltage ($V_{COM}$+ΔVn) or ($V_{COM}$−ΔVn) applied across the non-self-luminous pixel 300 of the display pixel 110A, $D_2$ is the duty cycle of the voltage ($V_{COM}$+ΔVn) or ($V_{COM}$−ΔVn) applied across the non-self-luminous pixel 300 of the display pixel 110B, $T_N$ is the transmittance of the non-self-luminous pixel 300 when the voltage ($V_{COM}$+ΔVn) or ($V_{COM}$−ΔVn) is applied across the non-self-luminous pixel 300, $D_S$ is a duty cycle of the voltage Vs, and $T_{COM}$ is the transmittance of the first non-self-luminous pixel of the first display pixel when the voltage difference between the two electrodes 310 of the non-self-luminous pixel 300 is zero.

The gray level $G_{p2}$ of the display pixel 100B could be controlled by adjusting the duty cycles $D_S$ and $D_{N2}$. The duty cycles of the self-luminous pixel 200 for the two non-self-luminous pixels 300 may be the same. For given image data for the gray levels $G_{p1}$ and $G_{p2}$, the values of $D_S$, $D_{N1}$ and $D_{N2}$ can be determined according to the equations (3) and (4).

Figure 8:
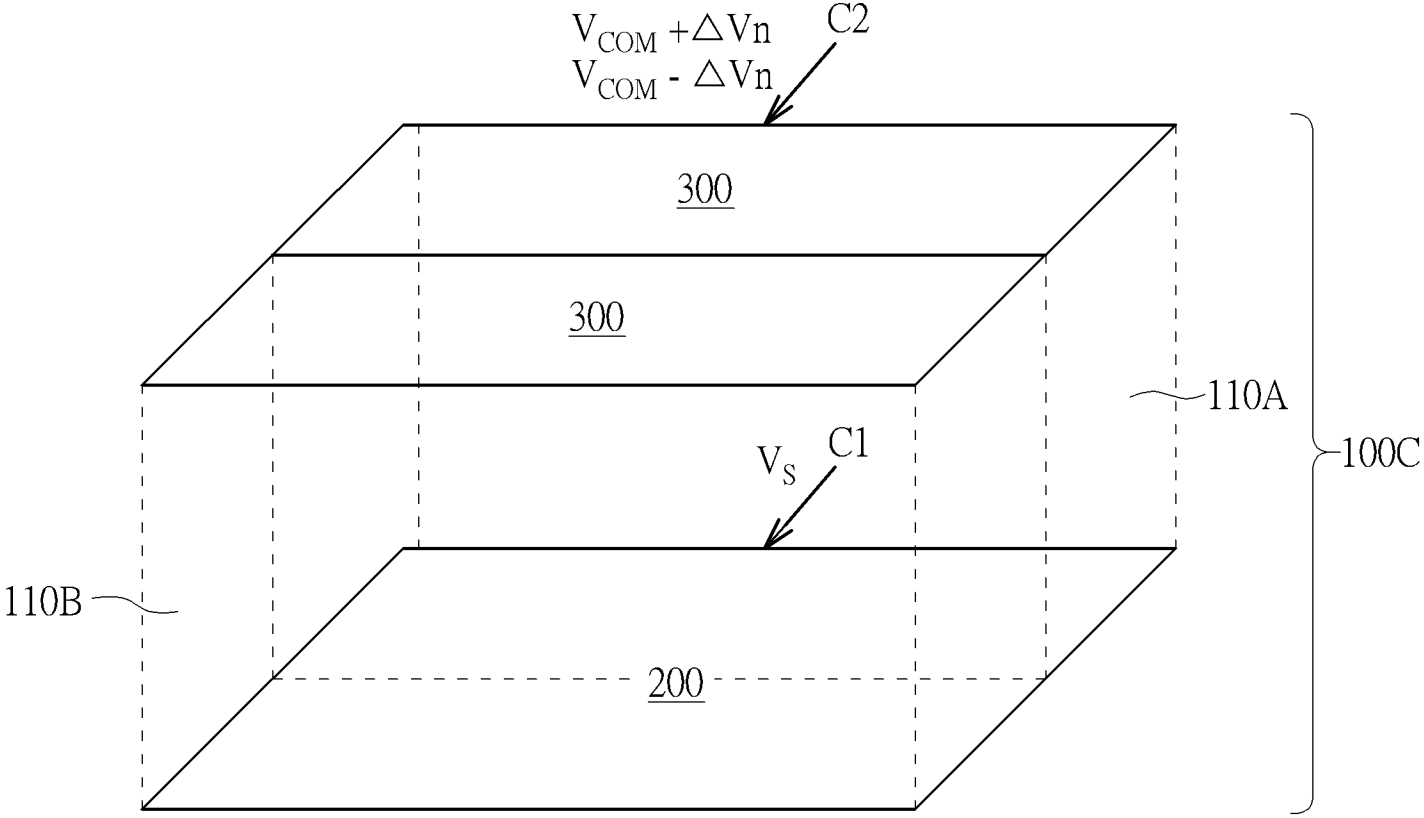
FIG. 8 shows another pixel group composed of a self-luminous pixel and two non-self-luminous pixels.
Figure 9:
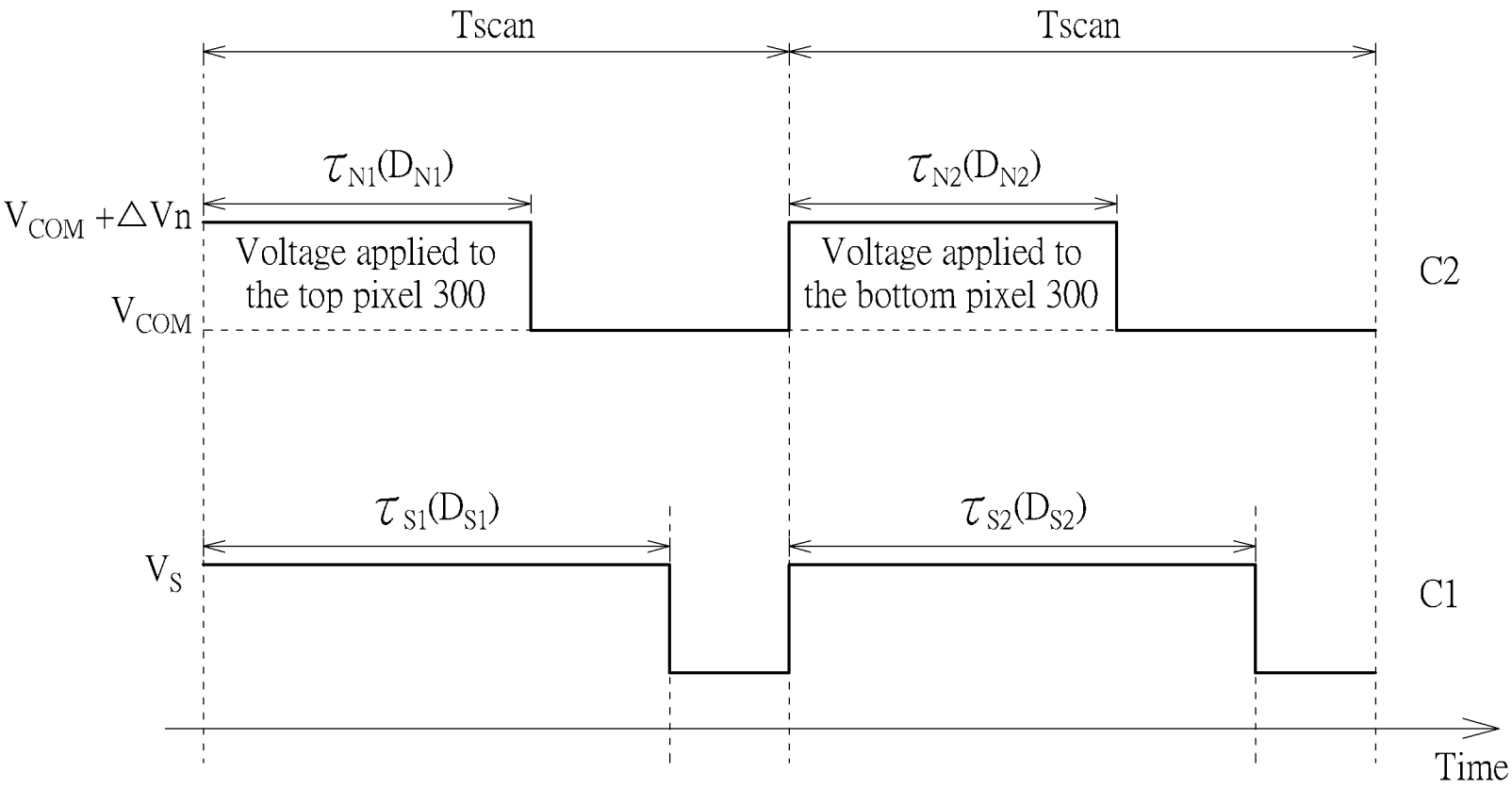
FIG. 9 shows the PWM driving timing of the pixel group in FIG. 8.

Alternative, the two non-self-luminous pixels 300 could be placed in the same column and are driven by the same output channel of the PWM driving circuit 70 as shown in FIG. 8. FIG. 8 shows a pixel group 100C composed of a self-luminous pixel 200 and two non-self-luminous pixels 300. FIG. 9 shows the PWM driving timing of the pixel group 100C within two scanning periods Tscan. In the embodiment, each pixel group 100C serves as two display pixels 110A and 110B of the display apparatus 10A. Moreover, because the self-luminous pixel 200 supplies the backlight for two non-self-luminous pixels 300 at different scanning periods Tscan, the average pixel gray level during the two scanning periods Tscan would be calculated. The gray level $G_{p1}$ of the display pixel 110A could be expressed as:

$$G_{p1} = B_S \frac{[\tau_{N1} \cdot T_N + (\tau_{S1} - \tau_{N1}) \cdot T_{COM} + \tau_{N1} \cdot T_{COM}]}{2T_{scan}} = \frac{B_S}{2}[D_{N1} \cdot T_N + (D_{S1} + D_{S2} - D_{N1}) \cdot T_{COM}] \quad (5)$$

The gray level $G_{p2}$ of the display pixel 110B could be expressed as:

$$G_{p2} = \frac{B_S}{2}[D_{N2} \cdot T_N + (D_{S1} + D_{S2} - D_{N2}) \cdot T_{COM}] \quad (6)$$

where $B_S$ is brightness of the self-luminous pixel 200 of the pixel group 100C when the voltage Vs is applied to the self-luminous pixel 200 of the pixel group 100C, $D_{N1}$ is a duty cycle of the voltage ($V_{COM}$+ΔVn) or ($V_{COM}$−ΔVn) applied across the non-self-luminous pixel 300 of the display pixel 110A of the pixel group 100C, $D_{N2}$ is a duty cycle of the voltage ($V_{COM}$+ΔVn) or ($V_{COM}$−ΔVn) applied across the non-self-luminous pixel 300 of the display pixel 110B of the pixel group 100C, $T_N$ is transmittance of the two non-self-luminous pixels 300 of the pixel group 100C when the voltage ($V_{COM}$+ΔVn) or ($V_{COM}$−ΔVn) is applied across the two non-self-luminous pixels 300 of the pixel group 100C, $D_{S1}$ is a duty cycle of the voltage Vs in a first scanning period Tscan, $D_{S2}$ is a duty cycle of the voltage Vs in a second scanning period Tscan, and $T_{COM}$ is the transmittance of the two non-self-luminous pixels 300 of the pixel group 100C when the voltage difference between the electrodes 310 of the non-self-luminous pixels 300 is zero.

For given image data for the gray levels $G_{p1}$ and $G_{p2}$, the values of $D_S$, $D_{N1}$, and $D_{N2}$ can be determined according to the equations (5) and (6).

Figure 10:
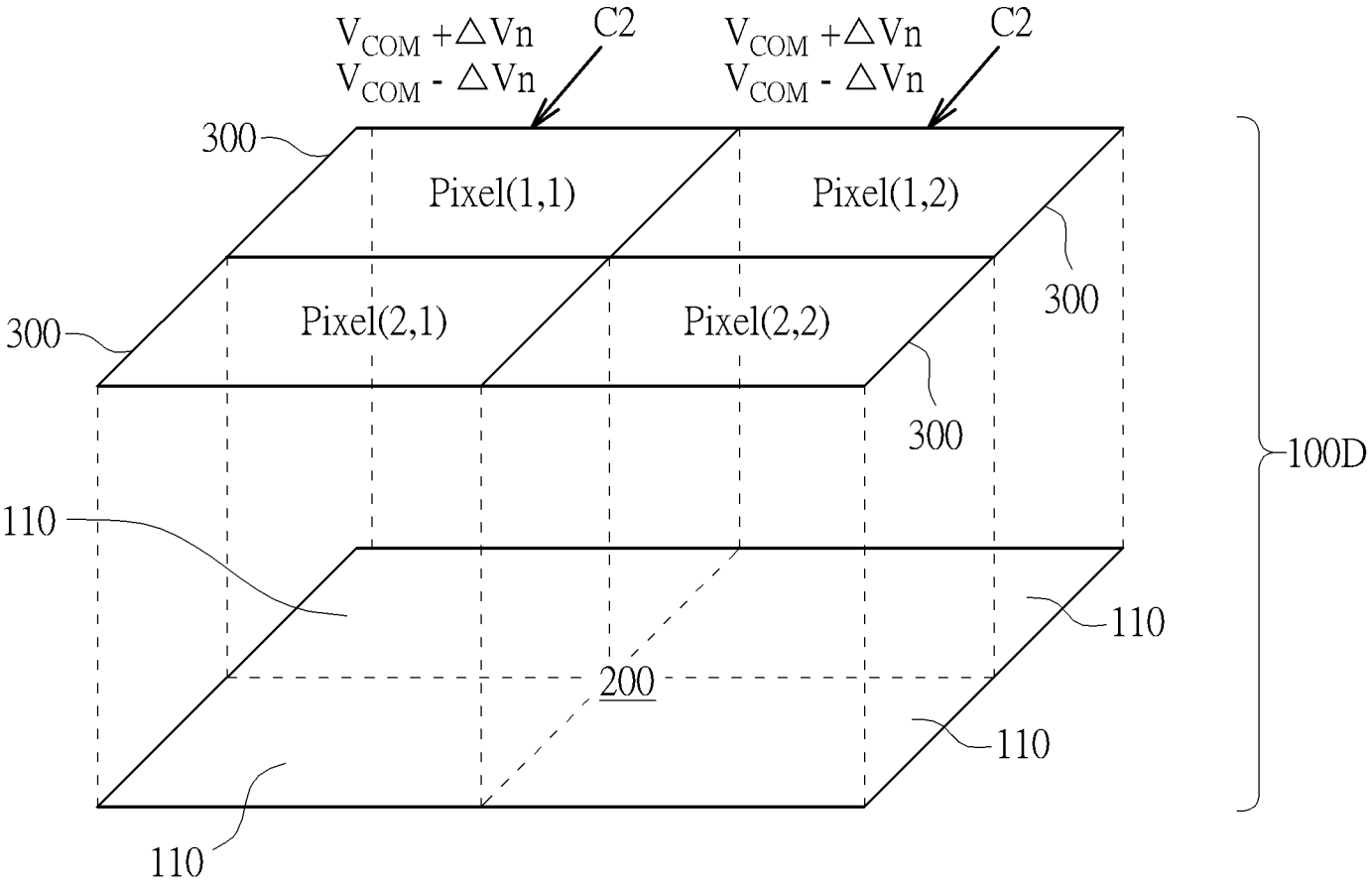
FIG. 10 shows another pixel group composed of a self-luminous pixel and an array of four non-self-luminous pixels.
Figure 11:
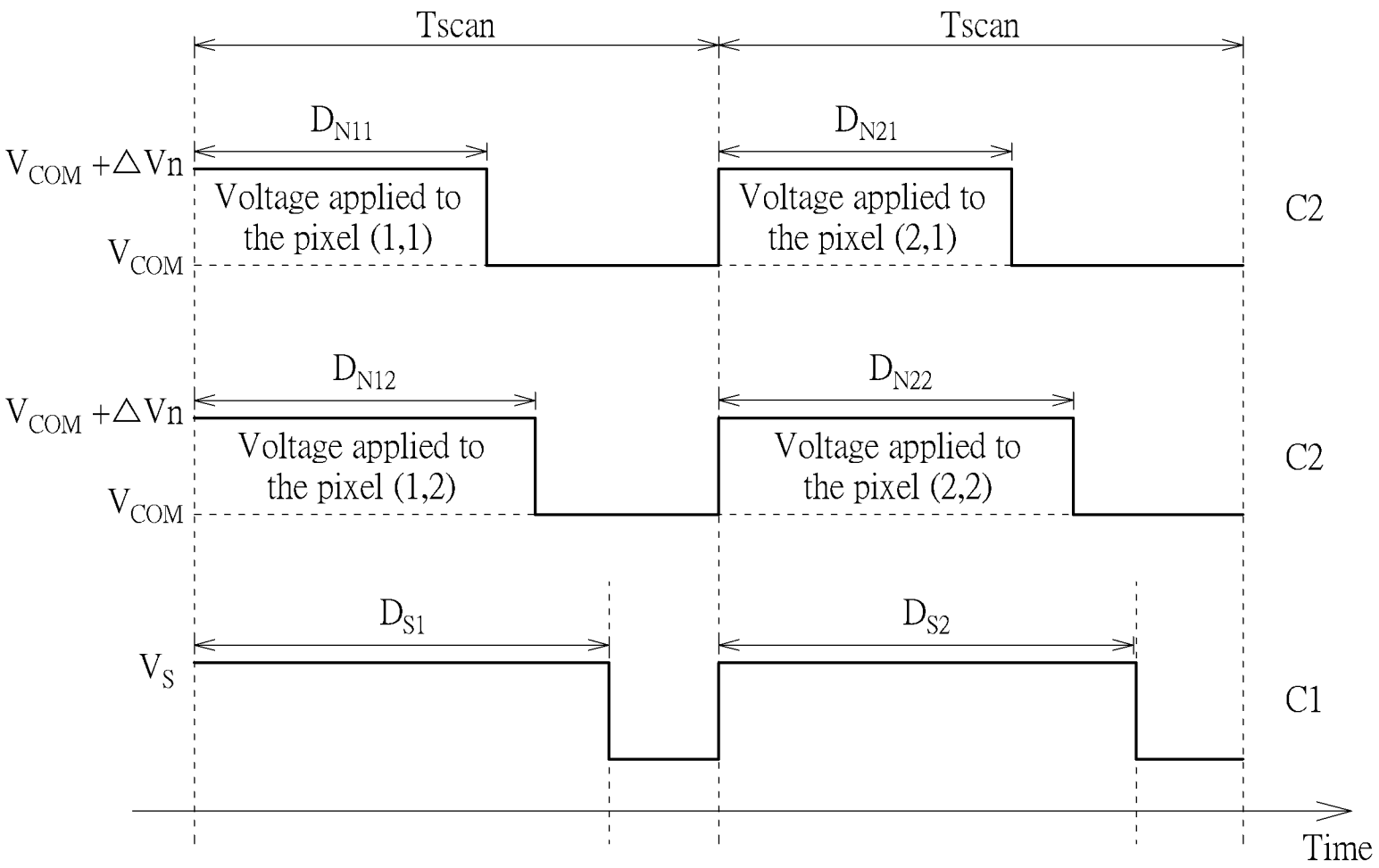
FIG. 11 shows the PWM driving timing of the pixel group in FIG. 10.

In an embodiment of the present invention, a self-luminous pixel 200 would supply the backlight and offer local dimming to an array of the non-self-luminous pixels 300. FIG. 10 shows a pixel group 100D composed of a self-luminous pixel 200 and an array of four non-self-luminous pixels 300. FIG. 11 shows the PWM driving timing of the pixel group 100D within two scanning periods Tscan. In the embodiment, each pixel group 100D serves as four display pixels 110 of the display apparatus 10A. The gray level $G_{p(i,j)}$ of the display pixel 110 in the $i^{th}$ row and the $j^{th}$ column can be expressed as:

$$G_{p(i,j)} = \frac{B_S}{2}[D_{N(i,j)} \cdot T_N + (D_{S1} + D_{S2} - D_{N(i,j)}) \cdot T_{COM}] \quad (7)$$

where i is equal to 1 or 2, and j is equal to 1 or 2. $B_S$ is brightness of a self-luminous pixel of the display pixel 110 when the voltage Vs is applied to the self-luminous pixel 200, $D_{N(i,j)}$ is a duty cycle of the voltage ($V_{COM}$+ΔVn) or ($V_{COM}$−ΔVn) applied across the non-self-luminous pixel 300, $T_N$ is transmittance of the non-self-luminous pixel 300 when the voltage ($V_{COM}$+ΔVn) or ($V_{COM}$−ΔVn) is applied across the non-self-luminous pixel 300, $D_{S1}$ is a duty cycle of the voltage Vs in a first scanning period Tscan, $D_{S2}$ is a duty cycle of the voltage Vs in a second scanning period Tscan, and $T_{COM}$ is the transmittance of the non-self-luminous pixel 300 when the voltage difference between the two electrodes 310 of the non-self-luminous pixel 300 is zero.

Figure 12:
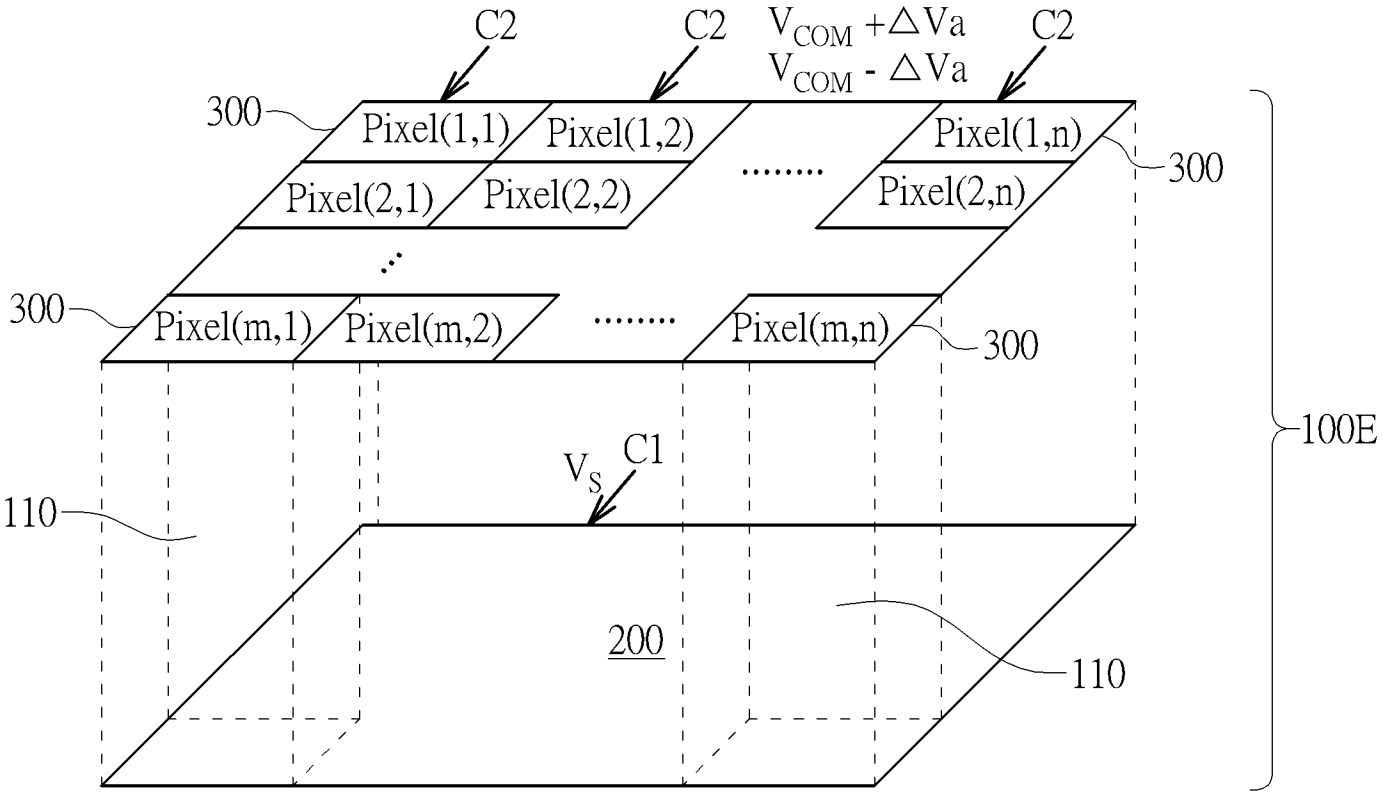
FIG. 12 shows another pixel group composed of a self-luminous pixel and an array of non-self-luminous pixels of a single non-self-luminous pixel module.
Figure 13:
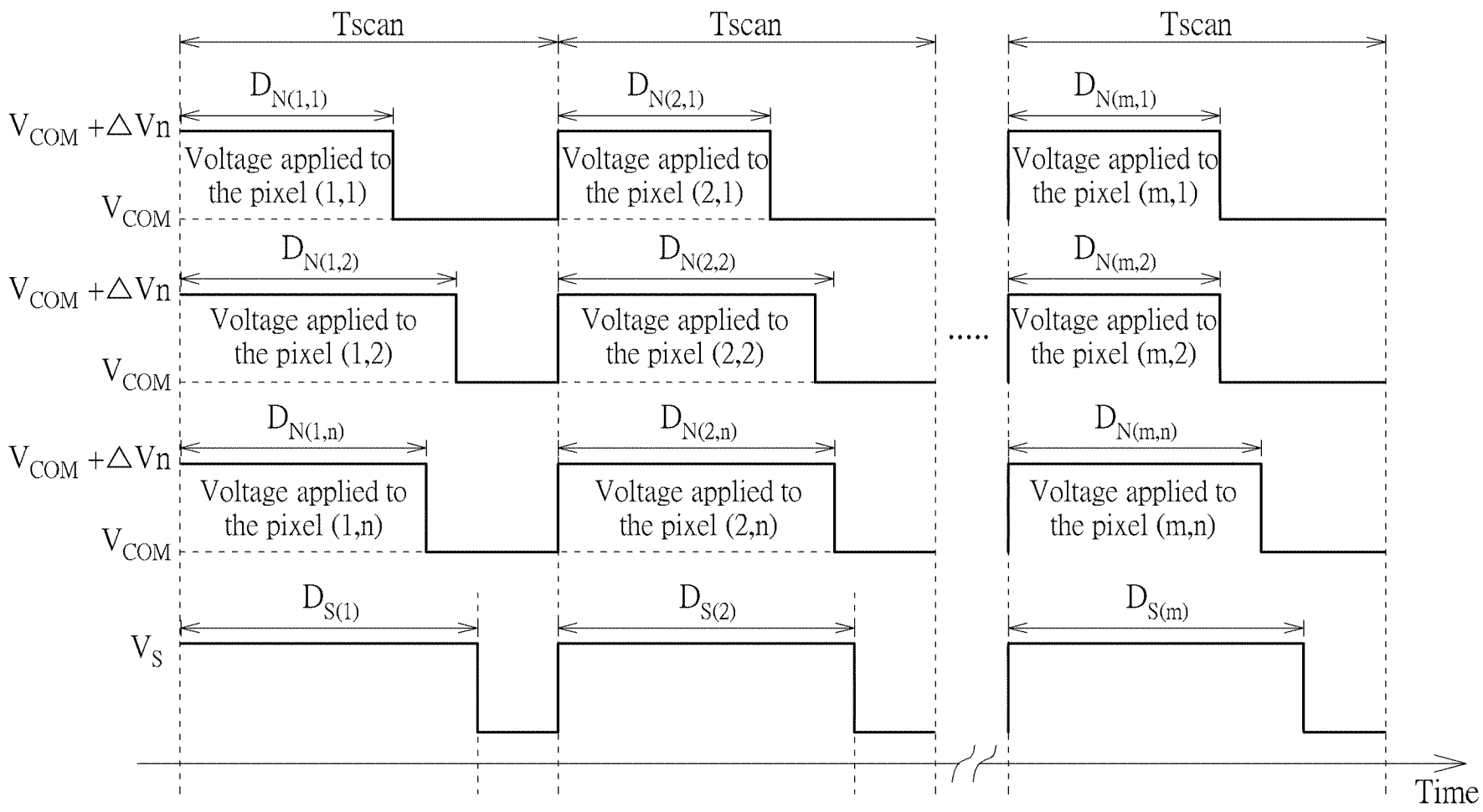
FIG. 13 shows the PWM driving timing of the pixel group in FIG. 12.

In an embodiment of the present invention, a self-luminous pixel 200 would supply backlight and offer local dimming to more non-self-luminous pixels 300. FIG. 12 shows a pixel group 100E composed of a self-luminous pixel 200 and an array of m×n non-self-luminous pixels 300, where m and n are integers greater than 2. FIG. 13 shows the PWM driving timing of the pixel group 100E within m scanning periods Tscan. In the embodiment, each pixel group 100E serves as (m×n) display pixels 110 of the display apparatus 10A. The gray level $G_{p(i,j)}$ of the display pixel 110 in the $i^{th}$ row and the $j^{th}$ column can be expressed as:

$$G_{p(i,j)} = \frac{B_S}{m}\left[D_{N(i,j)} \cdot T_N + \left(\sum_{k=1}^{m} D_{S(k)} - D_{N(i,j)}\right) \cdot T_{COM}\right] \quad (8)$$

where 1≤i≤m, and 1≤j=n. $B_S$ is brightness of a self-luminous pixel of the display pixel 110 when the voltage Vs is applied to the self-luminous pixel 200, $D_{N(i,j)}$ is a duty cycle of the voltage ($V_{COM}$+ΔVn) or ($V_{COM}$−ΔVn) applied across the non-self-luminous pixel 300, $T_N$ is transmittance of the non-self-luminous pixel 300 when the voltage ($V_{COM}$+ΔVn) or ($V_{COM}$−ΔVn) is applied across the non-self-luminous pixel 300, $D_{S(k)}$ is a duty cycle of the voltage Vs in a $k^{th}$ scanning period Tscan, and $T_{COM}$ is the transmittance of the non-self-luminous pixel 300 when the voltage difference between the two electrodes 310 of the non-self-luminous pixel 300 is zero. For given image data for the gray level $G_{p(i,j)}$, the values of $D_{S(k)}$ and $D_{N(i,j)}$ can be determined according to the equation (8).

Figure 14:
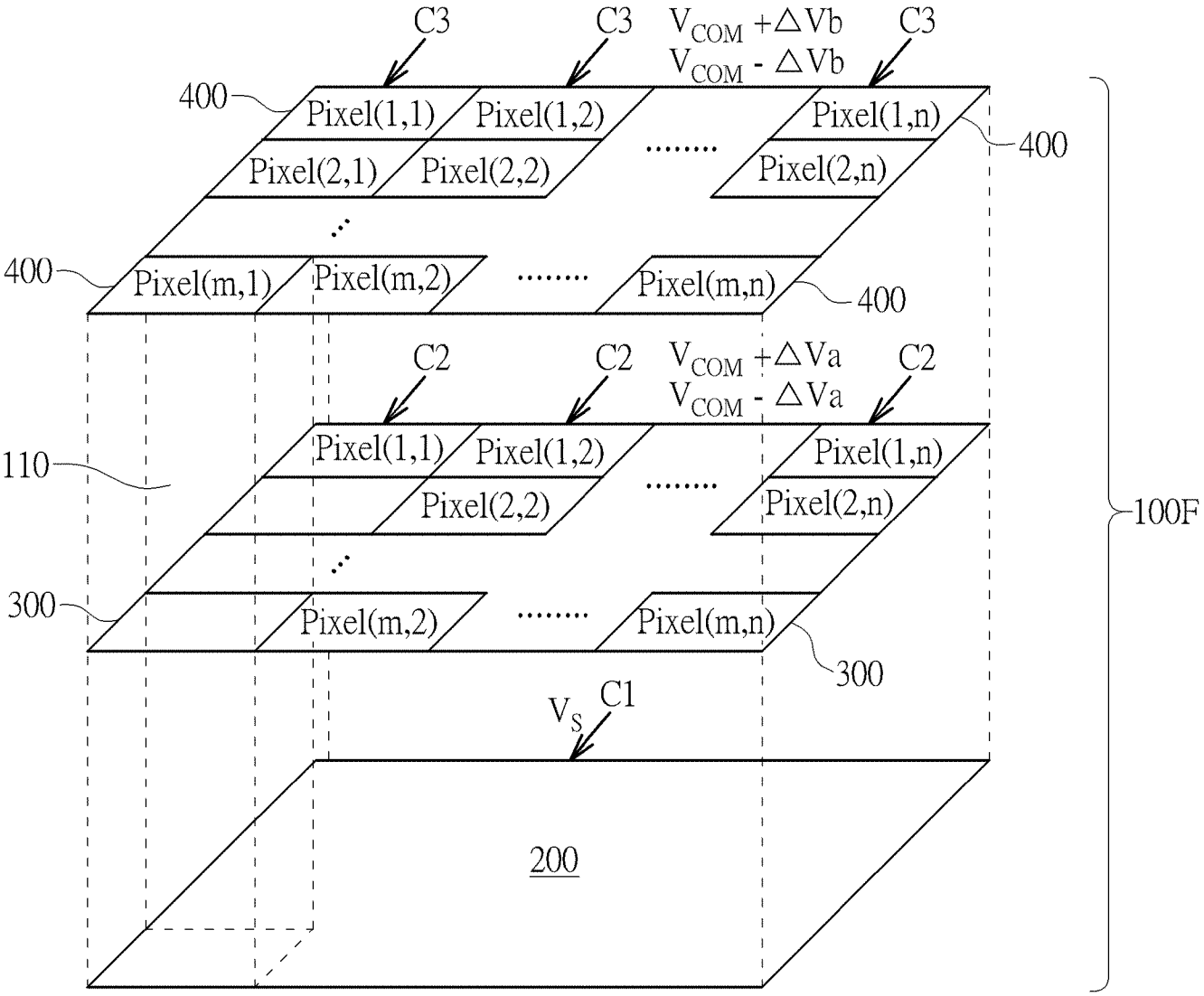
FIG. 14 shows a pixel group composed of a self-luminous pixel and two arrays of non-self-luminous pixels of two non-self-luminous pixel modules.
Figure 15:
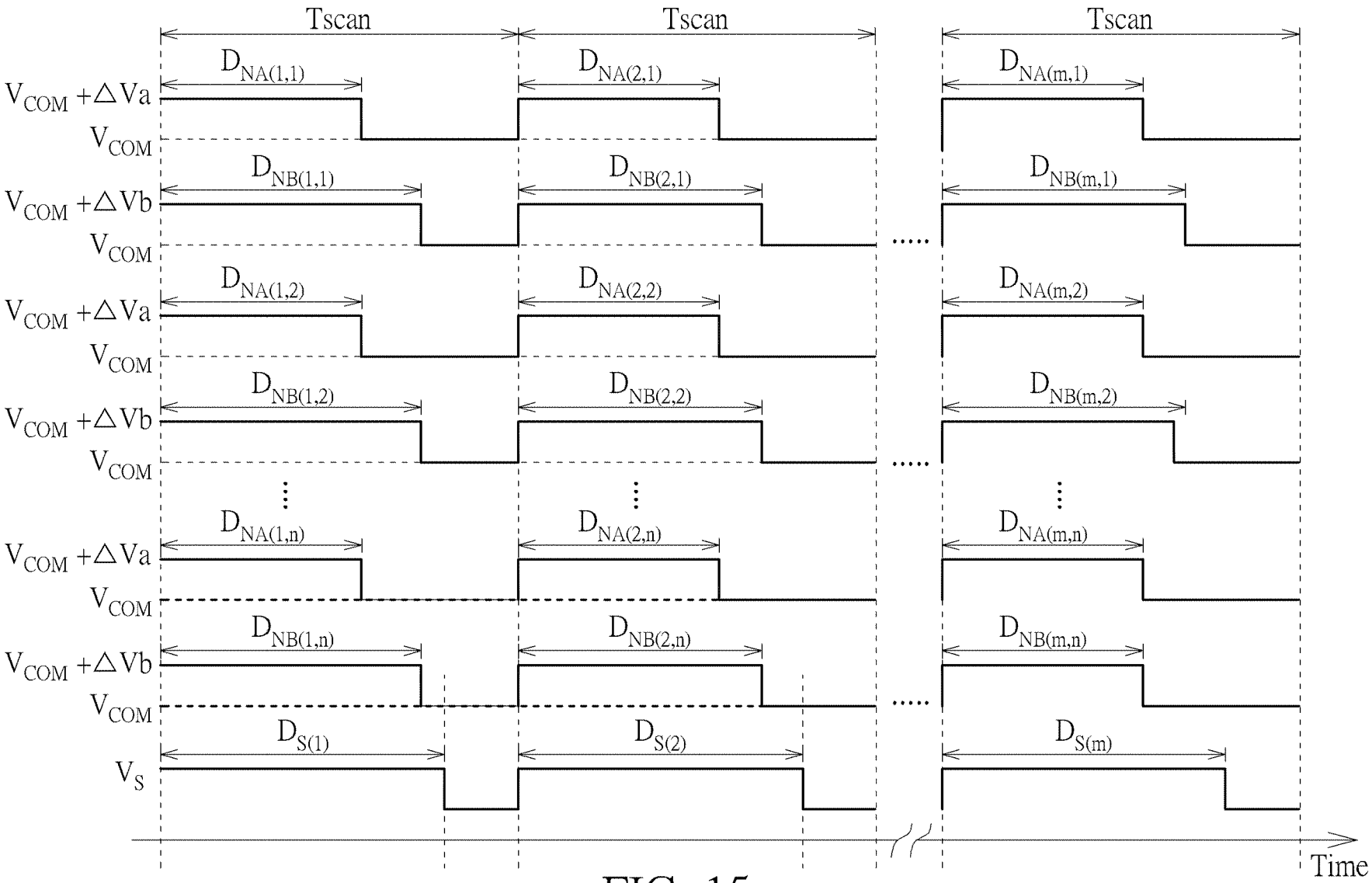
FIG. 15 shows the PWM driving timing of the pixel group in FIG. 14.

When a single self-luminous pixel 200 supplies backlight and offers local dimming to more non-self-luminous pixels 300, the contrast ratio of the display apparatus may be reduced. To increase the contrast ratio of the display apparatus, another non-self-luminous pixel module 40, as shown in FIG. 4, might be added to the display apparatus. FIG. 14 shows a pixel group 100F composed of a self-luminous pixel 200, an array of m×n non-self-luminous pixels 300, and an array of m×n non-self-luminous pixels 400 of the non-self-luminous pixel module 40. FIG. 15 shows the PWM driving timing of the pixel group 100F within m scanning periods Tscan. In the embodiment, each pixel group 100F serves as (m×n) display pixels 110 of the display apparatus 10B. In addition, the two non-self-luminous pixel modules 30 and 40 of the display apparatus 10B may comprise two LC layers, and the gray levels of the display pixels 110 of the pixel group 100F can be adjusted by adjusting the transmittances of the two LC layers and the brightness of the self-luminous pixel 200. The gray level $G_{p(i,j)}$ of the display pixel 110 in the $i^{th}$ row and the $j^{th}$ column can be expressed as:

$$G_{p(i,j)} = \frac{B_S}{m}\left[D_{NA(i,j)} \cdot T_{NA} \cdot T_{NB} + (D_{NB(i,j)} - D_{NA(i,j)}) \cdot T_{COMA} \cdot T_{NB} + \left(\sum_{k=1}^{m} D_{S(k)} - D_{NB(i,j)}\right) \cdot T_{COMA} \cdot T_{COMB}\right. \tag{9}$$

where $1 \le i \le m$, and $1 \le j \le n$. $B_S$ is brightness of the self-luminous pixel 200 when the voltage Vs is applied to the self-luminous pixel 200, $D_{NA(i,j)}$ is a duty cycle of a voltage ($V_{COM}$+ΔVa) or ($V_{COM}$−ΔVa) applied across the non-self-luminous pixel 300, $D_{NB(i,j)}$ is a duty cycle of a voltage ($V_{COM}$+ΔVb) or ($V_{COM}$−ΔVb) applied across the non-self-luminous pixel 400, $T_{NA}$ is transmittance of the non-self-luminous pixel 300 when the voltage ($V_{COM}$+ΔVa) or ($V_{COM}$−ΔVa) is applied across the non-self-luminous pixel 300, $T_{NB}$ is transmittance of the non-self-luminous pixel 400 when the voltage ($V_{COM}$+ΔVb) or ($V_{COM}$−ΔVb) is applied across the non-self-luminous pixel 400, $D_{S(k)}$ is a duty cycle of the voltage $V_{COM}$+ΔVa) or ($V_{COM}$−ΔVa) in a $k^{th}$ scanning period of the pixel group 100F, $T_{COMA}$ is the transmittance of the non-self-luminous pixel 300 when a voltage of zero volts is applied across the non-self-luminous pixel 300, and $T_{COMB}$ is the transmittance of the non-self-luminous pixel 400 when the voltage of zero volts is applied across the non-self-luminous pixel 400. For given image data for the gray level $G_{p(i,j)}$, the values of $D_{S(k)}$, $D_{NA(i,j)}$, and $D_{NB(i,j)}$ can be determined according to the equation (9).

In summary, the present invention provides a display apparatus with a multi-layer display structure. A self-luminous pixel module of the display apparatus may serve as a backlight for one or two non-self-luminous pixel modules of the display apparatus. The self-luminous pixel module also offers local dimming to enhance the color contrast ratio. A PWM driving circuit of the display apparatus provides first PWM signals to the self-luminous pixel module to control values of brightness of self-luminous pixels of the self-luminous pixel module. The PWM driving circuit further provides second PWM signals to the non-self-luminous pixel module to control values of transmittance of non-self-luminous pixels of the one or two non-self-luminous pixel modules. The gray level of each display pixel could be adjusted by adjusting the duty cycles of the first PWM signals and the second PWM signals.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display apparatus, comprising:

a self-luminous pixel module comprising a plurality of self-luminous pixels;

a first non-self-luminous pixel module, disposed on the self-luminous pixel module, and comprising a plurality of first non-self-luminous pixels;

a pulse width modulation (PWM) driving circuit configured to provide first PWM signals to the self-luminous pixel module to control brightness of the self-luminous pixels and provide second PWM signals to the first non-self-luminous pixel module to control transmittance of the first non-self-luminous pixels; and a second non-self-luminous pixel module disposed on the first non-self-luminous pixel module and comprising a plurality of second non-self-luminous pixels, wherein the PWM is further configured to provide third PWM signals to the second non-self-luminous pixel module to control transmittance of the second non-self-luminous pixels.

2. The display apparatus of claim 1, wherein each of the first non-self-luminous pixels comprises a first electrode and a second electrode, and a non-self-luminous medium is disposed between the first electrode and the second electrode.

3. The display apparatus of claim 2, wherein the first non-self-luminous pixel module further comprises a first substrate and a second substrate, the first electrode is disposed on the first substrate, and the second electrode is disposed on the first substrate or the second substrate.

4. The display apparatus of claim 3, wherein the first substrate or the second substrate comprises at least one member selected from a group consisting of a transparent material, an opaque material, a flexible material, a rigid material, a metallic material, a ceramic material, an insulating material, a metal compound material, a metal alloy material, an organic material, an inorganic material, a composite material, and a semiconductor material.

5. The display apparatus of claim 2, wherein the non-self-luminous medium comprises at least one member selected from a group consisting of an electrophoretic material, an electric fluid material, a liquid crystal material, a micro electromechanical reflective material, an electrowetting material, an electric ink material, a magnetic fluid material, an electrochromic material, an electromorphous material, and a thermochromic material.

6. The display apparatus of claim 1, wherein each of the self-luminous pixels comprises a first electrode and a second electrode, and a self-luminous medium is disposed between the first electrode and the second electrode.

7. The display apparatus of claim 6, wherein the self-luminous medium comprises at least one member selected from a group consisting of an electroluminescent material, a photoluminescent material, a cathodoluminescent material, a field emissive luminescent material, a vacuum fluorescent material, and a light-emitting diode material.

8. The display apparatus of claim 1, wherein a resolution of the self-luminous pixel module is equal, less or greater than a resolution of the first non-self-luminous pixel module.

9. The display apparatus of claim 1, wherein the self-luminous pixel module or the first non-self-luminous pixel module further comprise at least one member selected from a group consisting of a light absorbing material, a light reflecting material, a light deflecting material, a light diffusing material, a light-filtering material, an electric conductive material, an insulating material, and a photo reflective material.

10. The display apparatus of claim 1, wherein the pulse width modulation (PWM) driving circuit is electrically connected to electrodes of the self-luminous pixel module and the first non-self-luminous pixel module to control the electrodes in a synchronized or non-synchronized manner to allow the electrodes to change states of a non-self-luminous medium and a self-luminous medium disposed between the electrodes.

11. The display apparatus of claim 1, wherein a shape of the self-luminous pixel module or a shape of the first non-self-luminous pixel module are selected from a group consisting of a square shape, a rectangle shape, a fan shape, a triangle shape, a trapezoid shape, a circle shape, an oval shape, a diamond shape, an irregular polygon shape, a polygon shape, and an irregular shape.

12. A display apparatus, comprising:

a self-luminous pixel module comprising a plurality of self-luminous pixels;

a first non-self-luminous pixel module, disposed on the self-luminous pixel module, and comprising a plurality of first non-self-luminous pixels; and a pulse width modulation (PWM) driving circuit configured to provide first PWM signals to the self-luminous pixel module to control brightness of the self-luminous pixels and provide second PWM signals to the first non-self-luminous pixel module to control transmittance of the first non-self-luminous pixels;

wherein the self-luminous pixels and the first non-self-luminous pixels form a plurality of display pixels, each of the display pixels comprises one of the self-luminous pixels and one of the first non-self-luminous pixels; and wherein a gray level $G_p$ of a first display pixel of the display pixels is expressed as:

$$G_p=B_S[D_N\cdot T_N+(D_S-D_N)\cdot T_{COM}]$$

where $B_S$ is brightness of a self-luminous pixel of the first display pixel when a first voltage is applied to the self-luminous pixel of the first display pixel, $D_N$ is a duty cycle of a second voltage applied across a first non-self-luminous pixel of the first display pixel, $T_N$ is transmittance of the first non-self-luminous pixel of the first display pixel when the second voltage is applied across the first non-self-luminous pixel of the first display pixel, $D_S$ is a duty cycle of the first voltage, and $T_{COM}$ is transmittance of the first non-self-luminous pixel of the first display pixel when a voltage difference between two electrodes of the first non-self-luminous pixel of the first display pixel is zero.

13. A display apparatus, comprising:

a self-luminous pixel module comprising a plurality of self-luminous pixels;

a first non-self-luminous pixel module, disposed on the self-luminous pixel module, and comprising a plurality of first non-self-luminous pixels; and a pulse width modulation (PWM) driving circuit configured to provide first PWM signals to the self-luminous pixel module to control brightness of the self-luminous pixels and provide second PWM signals to the first non-self-luminous pixel module to control transmittance of the first non-self-luminous pixels;

wherein the self-luminous pixels and the first non-self-luminous pixels form a plurality of pixel groups, each pixel group comprises one of the self-luminous pixels and two of the first non-self-luminous pixels, and the self-luminous pixel and the two first non-self-luminous pixels of the each pixel group form a first display pixel and a second display pixel; and wherein a gray level $G_{p1}$ of the first display pixel is expressed as:

$$G_{p1}=B_S[D_{N1}\cdot T_N+(D_S-D_{N1})\cdot T_{COM}],$$

and a gray level $G_{p2}$ of the second display pixel is expressed as:

$$G_{p2}=B_S[D_{N2}\cdot T_N+(D_S-D_{N2})\cdot T_{COM}],$$

where $B_S$ is brightness of the self-luminous pixel of the pixel group when a first voltage is applied to the self-luminous pixel of the pixel group, $D_{N1}$ is a duty cycle of a second voltage applied across a first non-self-luminous pixel of the first display pixel, $D_{N2}$ is a duty cycle of the second voltage applied across a first non-self-luminous pixel of the second display pixel, $T_N$ is transmittance of the two first non-self-luminous pixels of the pixel group when the second voltage is applied across the two first non-self-luminous pixels of the pixel group, $D_S$ is a duty cycle of the first voltage, and $T_{COM}$ is transmittance of the two first non-self-luminous pixels of the pixel group when a voltage difference between electrodes of the two first non-self-luminous pixel of the pixel group is zero.

14. A display apparatus, comprising:

a self-luminous pixel module comprising a plurality of self-luminous pixels;

a first non-self-luminous pixel module, disposed on the self-luminous pixel module, and comprising a plurality of first non-self-luminous pixels; and a pulse width modulation (PWM) driving circuit configured to provide first PWM signals to the self-luminous pixel module to control brightness of the self-luminous pixels and provide second PWM signals to the first non-self-luminous pixel module to control transmittance of the first non-self-luminous pixels;

wherein the self-luminous pixels and the first non-self-luminous pixels form a plurality of pixel groups, each pixel group comprises one of the self-luminous pixels and two of the first non-self-luminous pixels, and the self-luminous pixel and the two first non-self-luminous pixels of the each pixel group form a first display pixel and a second display pixel; and wherein a gray level $G_{p1}$ of the first display pixel is expressed as:

$$G_{p1}=\frac{B_S}{2}[D_{N1}\cdot T_N+(D_{S1}+D_{S2}-D_{N1})\cdot T_{COM}],$$

and a gray level $G_{p2}$ of the second display pixel is expressed as:

$$G_{p2}=\frac{B_S}{2}[D_{N2}\cdot T_N+(D_{S1}+D_{S2}-D_{N2})\cdot T_{COM}],$$

where $B_S$ is brightness of the self-luminous pixel of the pixel group when a first voltage is applied to the self-luminous pixel of the pixel group, $D_{N1}$ is a duty cycle of a second voltage applied across a first non-self-luminous pixel of the first display pixel, $D_{N2}$ is a duty cycle of the second voltage applied across a first non-self-luminous pixel of the second display pixel, $T_N$ is transmittance of the two first non-self-luminous pixels of the pixel group when the second voltage is applied across the two first non-self-luminous pixels of the pixel group, $D_{S1}$ is a duty cycle of the first voltage in a first scanning period, $D_{S2}$ is a duty cycle of the first voltage in a second scanning period, and $T_{COM}$ is transmittance of the two first non-self-luminous pixels of the pixel group when a voltage difference between electrodes of the two first non-self-luminous pixel of the pixel group is zero.

15. A display apparatus, comprising:

a self-luminous pixel module comprising a plurality of self-luminous pixels;

a first non-self-luminous pixel module, disposed on the self-luminous pixel module, and comprising a plurality of first non-self-luminous pixels; and a pulse width modulation (PWM) driving circuit configured to provide first PWM signals to the self-luminous pixel module to control brightness of the self-luminous pixels and provide second PWM signals to the first non-self-luminous pixel module to control transmittance of the first non-self-luminous pixels;

wherein the self-luminous pixels and the first non-self-luminous pixels form a plurality of pixel groups, each pixel group comprises one of the self-luminous pixels and a non-self-luminous pixel array, the non-self-luminous pixel array comprises m rows and n columns of the first non-self-luminous pixels, m and n are integers greater than 1, and the self-luminous pixel and the non-self-luminous pixel array form a plurality of display pixels arranged in m rows and n columns; and wherein a gray level $G_{p(i,j)}$ of a first display pixel of the display pixels is expressed as:

$$G_{p(i,j)} = \frac{B_S}{m}\left[D_{N(i,j)} \cdot T_N + \left(\sum_{k=1}^{m} D_{S(k)} - D_{N(i,j)}\right) \cdot T_{COM}\right],$$

where the first display pixel is located at an $i^{th}$ row and a $j^{th}$ column of the display pixels, $B_S$ is brightness of a self-luminous pixel of the first display pixel when a first voltage is applied to the self-luminous pixel of the first display pixel, $D_{N(i,j)}$ is a duty cycle of a second voltage applied across a first non-self-luminous pixel of the first display pixel, $T_N$ is transmittance of the first non-self-luminous pixel of the first display pixel when the second voltage is applied across the first non-self-luminous pixel of the first display pixel, $D_{S(k)}$ is a duty cycle of the first voltage in a $k^{th}$ scanning period, and $T_{COM}$ is transmittance of the first non-self-luminous pixel of the first display pixel when a voltage of zero volts is applied across the first non-self-luminous pixel of the first display pixel.

16. The display apparatus of claim 1, wherein a resolution of the second non-self-luminous pixel module is equal to, less or greater than the resolution of the first non-self-luminous pixel module or the resolution of self-luminous pixel module.

17. The display apparatus of claim 1, wherein the self-luminous pixels, the first non-self-luminous pixels and the second non-self-luminous pixels form a plurality of pixel groups, each pixel group comprises one of the self-luminous pixels and a non-self-luminous pixel array, the non-self-luminous pixel array comprises m rows and n columns of the first non-self-luminous pixels, m and n are integers greater than 1, and the self-luminous pixel and the non-self-luminous pixel array form a plurality of display pixels arranged in m rows and n columns.

18. The display apparatus of claim 17, wherein a gray level $G_{p(i,j)}$ of a first display pixel of the display pixels is expressed as:

$$G_{p(i,j)} = \frac{B_S}{m}\left[D_{NA(i,j)} \cdot T_{NA} \cdot T_{NB} + (D_{NB(i,j)} - D_{NA(i,j)}) \cdot T_{COMA} \cdot T_{NB} + \left(\sum_{k=1}^{m} D_{S(k)} - D_{NB(i,j)}\right) \cdot T_{COMA} \cdot T_{COMB},\right.$$

where the first display pixel is located at an $i^{th}$ row and a $j^{th}$ column of the display pixels, $B_S$ is brightness of a self-luminous pixel of the first display pixel when a first voltage is applied to the self-luminous pixel of the first display pixel, $D_{NA(i,j)}$ is a duty cycle of a second voltage applied across a first non-self-luminous pixel of the first display pixel, $D_{NB(i,j)}$ is a duty cycle of a third voltage applied across a second non-self-luminous pixel of the first display pixel, $T_{NA}$ is transmittance of the first non-self-luminous pixel of the first display pixel when the second voltage is applied across the first non-self-luminous pixel of the first display pixel, $T_{NB}$ is transmittance of the second non-self-luminous pixel of the first display pixel when the third voltage is applied across the second non-self-luminous pixel of the first display pixel, $D_{S(k)}$ is a duty cycle of the first voltage in a $k^{th}$ scanning period, $T_{COMA}$ is transmittance of the first non-self-luminous pixel of the first display pixel when a voltage of zero volts is applied across the first non-self-luminous pixel of the first display pixel, and $T_{COMB}$ is transmittance of the second non-self-luminous pixel of the first display pixel when the voltage of zero volts is applied across the second non-self-luminous pixel of the first display pixel.

* * * * *